United States Patent [19]

Vierkötter

[11] 4,355,739

[45] Oct. 26, 1982

[54] LIQUID STORAGE CONTAINER

[75] Inventor: Peter Vierkötter, Leverkusen, Fed. Rep. of Germany

[73] Assignee: Henkel Kommanditgesellschaft auf Aktien, Düsseldorf-Holthausen, Fed. Rep. of Germany

[21] Appl. No.: 189,605

[22] Filed: Sep. 22, 1980

[30] Foreign Application Priority Data

Oct. 6, 1979 [DE] Fed. Rep. of Germany ..... 2940564

[51] Int. Cl.[3] ..... B67D 5/52

[52] U.S. Cl. ..... 222/134; 222/136; 222/144.5; 222/145; 222/383; 239/305; 239/333; 239/324

[58] Field of Search ..... 239/304, 305, 333, 334, 239/414; 222/144.5, 145, 134, 136, 137, 382, 383-385, 464

[56] References Cited

U.S. PATENT DOCUMENTS

| | | | |
|---|---|---|---|
| 1,071,432 | 8/1913 | Kelley | 239/305 X |
| 3,593,887 | 7/1971 | Morane | 222/136 |
| 3,760,986 | 9/1973 | Castner et al. | 222/145 X |
| 3,786,963 | 1/1974 | Metzler | 222/136 |

*Primary Examiner*—Allen N. Knowles
*Attorney, Agent, or Firm*—Hammond & Littell, Weissenberger and Muserlian

[57] ABSTRACT

This invention is directed to a liquid storage container. More particularly, this invention is directed to a liquid storage container that can be connected or attached to a spray pump which comprises two separate chambers to hold liquid components, each chamber having a take-up tube which leads to a mixing chamber contained within a movable member attached to a movable external selector, the member having openings therein, wherein, when the external selector is moved, the movable member attached thereto moves in a manner such that the ratio of the quantities of liquid components from the chambers varies.

5 Claims, 5 Drawing Figures

LIQUID STORAGE CONTAINER

FIELD OF THE INVENTION

This invention is directed to a liquid storage container. More particularly, this invention is directed to a liquid storage container that can be connected to a spray pump.

BACKGROUND OF THE INVENTION

Liquid storage containers with attached pumps for the withdrawal and spraying of liquid contents comprised of two components, are known. For example, in U.S. Pat. No. 3,966,089 a delivery system is described whereby a two-component liquid cleaner with individual components located in a water container and a concentrate container can be dispensed with the aid of the disclosed apparatus. The concentrate container is to be largely integrated into a screw top of the water container and is to be opened by screwing the screw top tight. The components, that is, the concentrate and the water, can be removed only in a predetermined, unalterable mixing ratio.

The use of a spraying device with a fixed mixing ratio has not always been satisfactory. For example, the ratio of components used in a cleaning agent could advantageously be varied according to the degree of soiling. Therefore, there has been a need for a device for dispensing a two component fluid whereby the ratio of the components present in the fluid can be varied.

OBJECTS OF THE INVENTION

It is an object of the invention to provide a novel liquid storage container that can be connected to a spray pump.

It is also an object of the invention to provide a liquid storage container that can be connected to a spray pump whereby two components can be dispensed and whereby the ratio of the two components can be varied.

These and other objects of the invention will become more apparent in the discussion below.

DETAILED DESCRIPTION OF THE INVENTION

Figure 1:
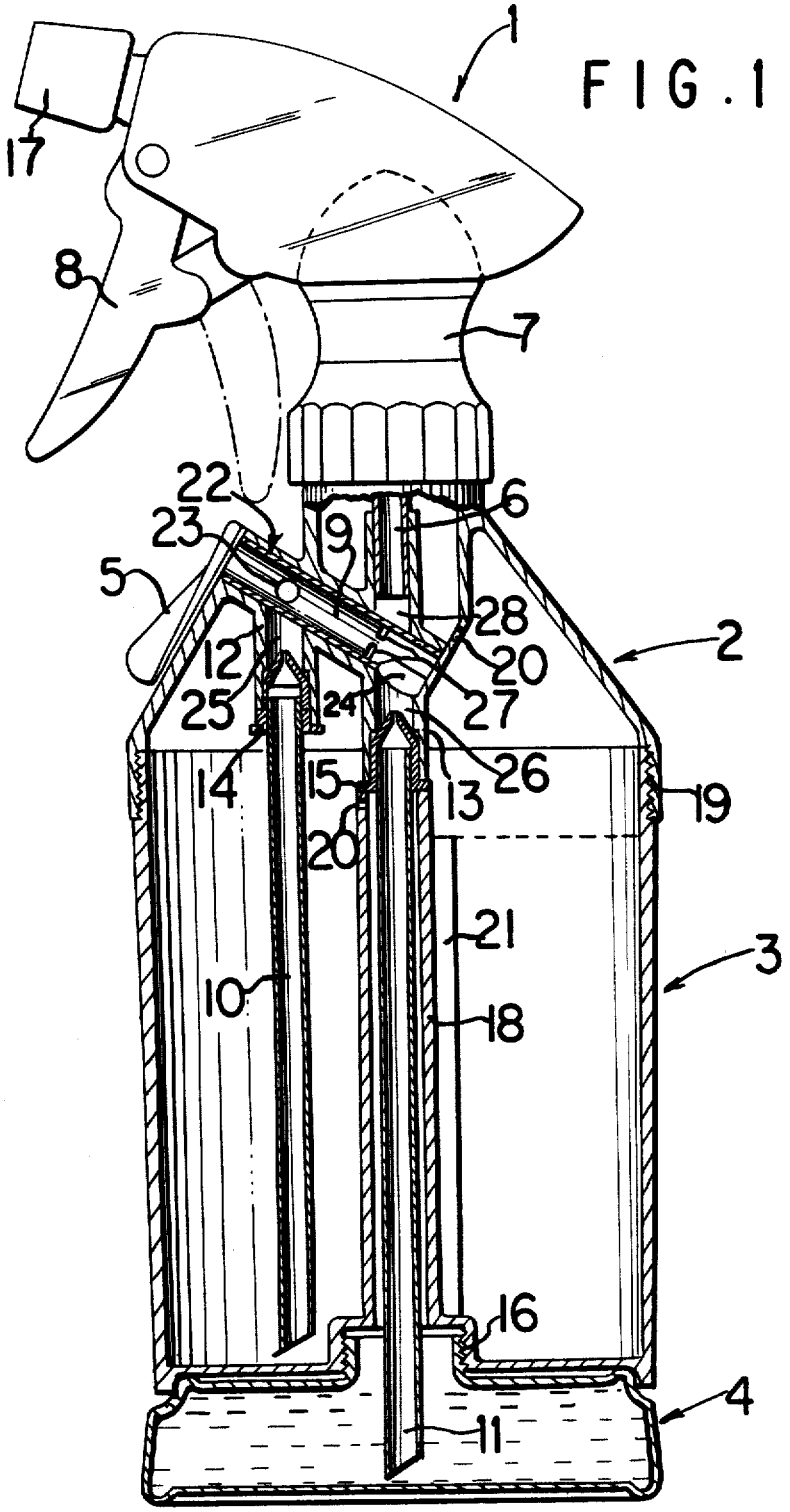
FIG. 1 represents a cross-sectional view of a liquid storage container with an attached spray pump.

Applicants have developed a liquid storage vessel in which the mixing ratio of two components can be varied. According to Applicants' invention, a liquid storage container contains separate chambers to hold different liquid components, which are connected to a mixing chamber which may be emptied by suction, via a suction tube from a spray pump, for example. The individual chambers are connected, via separate take-up tubes with return valves, to the mixing chamber, and the cross-sections of the outlets of the take-up tubes into the mixing chamber are adjustable with respect to a monitoring or a pre-selection of the component mixing ratio. The mixing ratio is varied by a regulator or selector that can be manipulated from the outside.

A mixture consisting of two or more components, mixed in any manner, can be sprayed by using the liquid storage container according to the invention. Thus, after a simple regulation, the required or desired mixture, for example, a water/concentrate mixture, can be fed into the mixing chamber with the aid of the spray pump, removed from there via a suction tube, and sprayed with the spray pump.

According to one embodiment of the invention, the individual chambers are designed so that when they are placed together, they have a substantially uniform outer shape, that is, they comprise the outer shape of a single container. In this arrangement the individual chambers may be arranged one above the other and may be rigidly connected to one another, preferably screwed together. The take-up tube of the respective lower individual chamber is then led advantageously through an internal tube of the respective individual chamber lying above it and into the mixing chamber. The storage container according to the invention, which consists of several parts joined together, has the appearance of a single vessel from the outside and can be treated like a single container because of the connection of the individual parts by screwing together.

The invention can perhaps be better appreciated by making reference to the drawings. According to FIGS. 1 and 2, the arrangement according to the invention consists of a spray pump 1, top portion 2, upper chamber 3, and lower chamber 4. A mixing ratio selector or regulating lever 5 for the adjustment of the mixing ratio of main and secondary components from the individual chambers 3 and 4, respectively, can be seen in top portion 2. Regulating lever 5 is attached to one end of rotating cylinder 22, which has openings 23 and 24. The interior of rotating cylinder 22 comprises mixing chamber 9.

To fit the individual parts together, spray pump 1 with suction tube 6 is screwed on top portion 2 with the aid of screw ring 7 equipped with an integrated gripping bead roll in such a way that the activating lever 8 of spray pump 1 is shifted by 90° in a clockwise direction with respect to regulating lever means 5. In other words, when top portion 2 is initially placed upon upper chamber 3, activating lever 8 is substantially perpendicular to the direction of regulating lever 5. The top portion is then turned 90° clockwise so that activating lever 8 is aligned with regulating lever 5, at which point top portion 2 is fixedly attached to upper chamber 3.

Return valves, that is, lipped valves 14 and 15, are inserted into outlet sleeves 12 and 13, which valves are connected to take-up tubes 10 and 11 from the upper chamber 3 and lower chamber 4, respectively. These valves are advantageously designed so that they are at the same time suitable as seats for take-up tubes 10 and 11. Take-up tubes 10 and 11 advantageously extend to the bottom of the respective containers, chambers 3 and 4. Upper chamber 3 may be, for example, a water container, and lower chamber 4, may be, for example, a concentrate container, which is preferably rigidly connected to the water container or upper chamber 3 by means of screw thread 16.

When the liquid storage container consisting of the chambers 3 and 4 is operated with the attached spray pump 1, the liquid components are withdrawn by pressing activating lever 8, in a mixing ratio preset (and adjustable) with the aid of regulating lever 5, from chambers 3 and 4 via rising tubes 10 and 11, through valves 14 and 15 into outlet sleeve chambers 25 and 26, and through openings 23 and 24, respectively, into mixing chamber 9 and delivered mixed, via the suction tube 6 of spray pump 1, to spraying nozzle 17. The supply rate from each individual chamber 3 or 4 can be adjusted with the aid of regulating lever 5. Dependent upon the particular configuration and arrangement of openings 23 and 24 in cylinder 22, the components from chambers 3 and 4 could be mixed in any desired range of ratios, including in such a manner that only unmixed liquid from one or the other chamber 3 or 4 is delivered for a particular setting of regulating lever 5. Valves 14 and 15 prevent an equalization of the levels of the two components in each of chambers 3 and 4—thus they disconnect so-called communicating tubes—and also, primarily, prevent reflux from mixing chamber 9 and suction tube 6 into the one or the other of chambers 3 and 4.

Liquid from mixing chamber 9 flows through perforations 27 in cylinder 22 into suction tube chamber 28. The perforations 27, or another suitable passage means, are arranged on cylinder 22 so as to be aligned with chamber 28.

Figure 2:
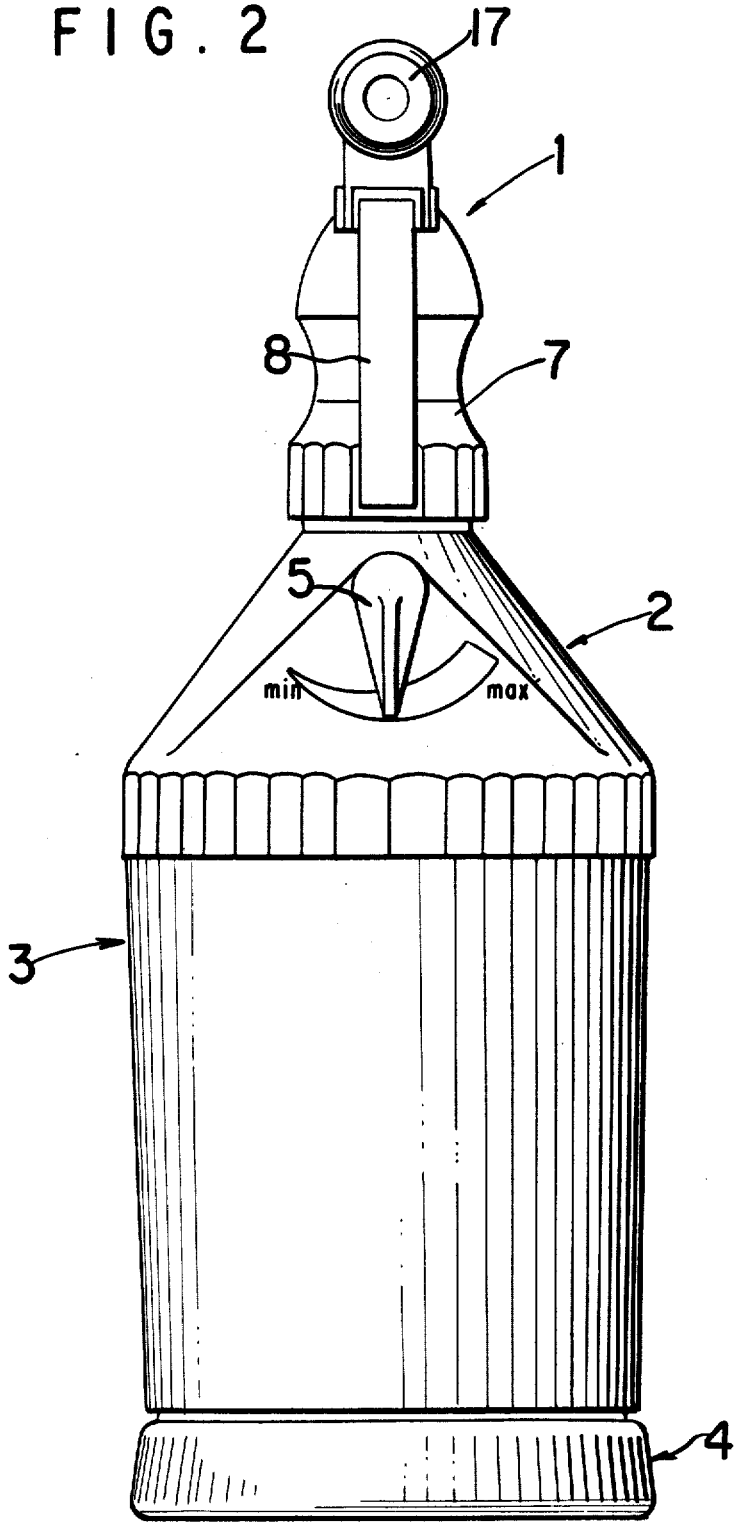
FIG. 2 represents an exterior view of the device shown in FIG. 1.

In the embodiment of the invention shown in FIG. 1, a center tube 18 leads through the center of upper chamber 3, which serves as an entrance for rising tube 11 of lower chamber 4 into mixing chamber 9. Additional air can be fed in through separate vents 20.

Figures 3A, 3B, 3C:
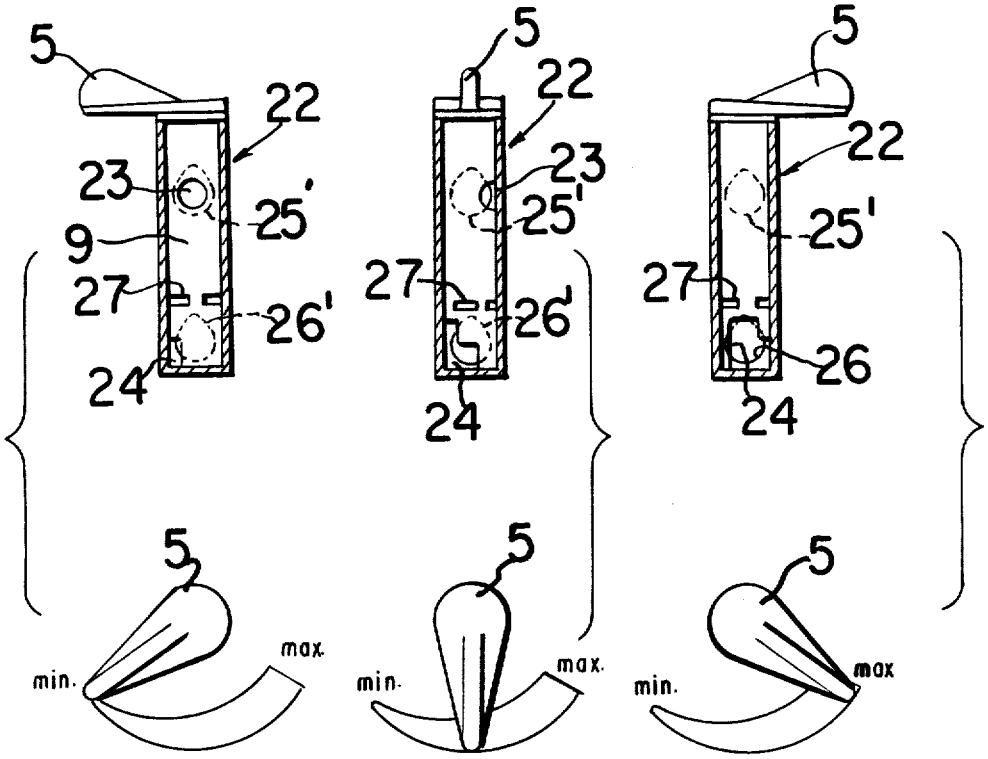
FIGS. 3A to 3C depict the mixing chamber cross-sectional openings as they correspond to positions of the mixing ratio selector.

FIGS. 3A to 3C depict the relationship between settings of regulating lever 5 and the passage of components into mixing chamber 9. Openings 23 and 24 are arranged so that, for a preferred water/concentrate system, a mixture with the largest proportion of water is delivered when regulating proportion of water is delivered when regulating lever is set at "min". (In this system, chambers 3 and 4 contain water and concentrate, respectively.) Dotted areas 25' and 26' represent the openings of outlet chambers 25 and 26, respectively. In the configuration shown in FIG. 3A, the water to concentrate ratio would be about 6:1. When regulating lever 5 is moved to a center position, as in FIG. 3B, a 1:1 mixture is delivered. In FIG. 3C, where regulating lever 5 has been set on "max", the supply from chamber 3, the chamber containing water, has been shut off so that only pure concentrate is dispensed.

The inner system generally is ventilated through a screw thread 19 between top portion 2 and upper individual chamber 3. At this, a bar 21 is shown schematically that serves as water mark. Such a mark makes the filling level of the respective individual chamber 3 plainly visible by a simple means, and the container or chamber can be colored as desired.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A liquid storage container that can be connected or attached to a spray pump means which comprises two separate chambers to hold liquid components, each chamber having a one-way valved suction take-up tube which leads to a mixing chamber contained within a movable member attached to a movable external selector means, the member having openings therein, wherein, when the external selector means is moved, the movable member attached thereto moves in a manner such that the ratio of the quantities of liquid components sucked from the chambers varies, said mixing chamber being adapted to be connected or attached to a spray pump means.

2. The container of claim 1 wherein movement of the selector means can vary the ratio of liquid components from about 6:1 to 0:1.

3. The container of claim 1 wherein the chambers are arranged so that they can be fitted together, one above the other, and that they are rigidly connected to one another.

4. The container of claim 3 wherein the chambers are screwed together.

5. The container of claim 3 wherein the take-up tube of the lower chamber leads through the upper chamber to the mixing chamber.

* * * * *